United States Patent [19]

Duff et al.

[11] Patent Number: 4,919,282

[45] Date of Patent: Apr. 24, 1990

[54] MOVABLE GONDOLA SHELVING WITH HIDDEN SHELF ADJUSTMENT MECHANISM

[76] Inventors: Terry L. Duff, 1201 Carson Dr., Seminole, Okla. 74868; William R. Gundlach, 2 Seneca, Shawnee, Okla. 74801

[21] Appl. No.: 50,640

[22] Filed: May 13, 1987

[51] Int. Cl.[5] ..... A47F 5/00

[52] U.S. Cl. ..... 211/134; 211/187; 211/207

[58] Field of Search ..... 211/134, 187, 190, 191, 211/207, 150, 170, 174, 208, 153; 248/412, 161; 108/144, 111

[56] References Cited

U.S. PATENT DOCUMENTS

| | | | |
|---|---|---|---|
| 386,927 | 7/1888 | Meyer . | |
| 431,745 | 7/1890 | Haven . | |
| 446,472 | 2/1891 | Roberts . | |
| 486,305 | 11/1892 | Thompson et al. . | |
| 564,005 | 7/1896 | Coburn . | |
| 618,510 | 1/1899 | Kail . | |
| 2,318,458 | 5/1943 | Boren | 311/35 |
| 2,703,692 | 3/1955 | Felix | 248/244 |
| 2,744,714 | 5/1956 | Parke | 248/245 |
| 2,787,382 | 4/1957 | Williams | 211/148 |
| 2,788,902 | 4/1957 | Nowicki | 211/147 |
| 2,901,205 | 8/1959 | Gredell | 248/245 |
| 2,908,395 | 10/1959 | Patterson | 211/49 |
| 2,920,244 | 1/1960 | Miksit et al. | 317/99 |
| 2,971,657 | 2/1961 | Zadek | 211/147 |
| 2,992,742 | 7/1961 | Pendergrast, Jr. | 211/134 X |
| 2,998,107 | 8/1961 | Zimmerla | 189/34 |
| 3,040,905 | 6/1962 | Gingher et al. | 211/148 |
| 3,161,158 | 12/1964 | Lurey | 108/2 |
| 3,172,376 | 3/1965 | Havlis | 108/59 |
| 3,188,986 | 6/1965 | La Vigne | 108/144 |
| 3,209,709 | 10/1965 | Shoffner | 108/27 |
| 3,356,395 | 12/1967 | Dygert et al. | 287/54.1 |
| 3,368,784 | 2/1968 | Peterson | 248/245 |
| 3,415,477 | 12/1968 | Kondur | 248/225 |
| 3,511,193 | 5/1970 | Schild | 108/152 |
| 3,517,623 | 6/1970 | Goldstein et al. | 108/114 |
| 3,692,189 | 9/1972 | Preston | 211/134 |
| 3,771,466 | 11/1973 | Ferdinand et al. | 108/111 X |
| 4,119,044 | 10/1978 | Hines | 108/27 |
| 4,193,351 | 3/1980 | Belokin, Jr. | 108/59 |

OTHER PUBLICATIONS

Photocopy of excerpts from a 1985/86 Uniweb catalog, 4 pages, date unknown.

Cannon Equipment Co. photocopies of 6 catalog pages including rolling bread and bakery racks and other carts for moving bulk product, Copyright 1984.

*Primary Examiner*—Reinaldo P. Machado
*Assistant Examiner*—Sarah A. Lechok
*Attorney, Agent, or Firm*—Dunlap, Codding, Peterson & Lee

[57] ABSTRACT

A merchandise display unit which comprises a base unit having a rolling platform on which a pair of channeled standards and a center panel are mounted. Cantilevered shelves are included and are adjustable by a pair of cam assemblies connected to the rear corners of the shelf. When the shelves are mounted on the standards, the cam assembly is concealed inside the standards. An arm extends outside the channel from each cam assembly for operating the cam mechanism and permits the shelf to be adjusted while the shelf is maintained in a level position. One or two similarly constructed side units may be removably connected to the base to form 3- and 4-sided units, respectively. Preferably the base unit, each side unit and each shelf are each a single weldment.

16 Claims, 5 Drawing Sheets

MOVABLE GONDOLA SHELVING WITH HIDDEN SHELF ADJUSTMENT MECHANISM

FIELD OF THE INVENTION

The present invention relates to shelving in general, and to merchandise display shelving, also called gondola shelving, in particular.

SUMMARY OF THE INVENTION

The present invention comprises a merchandise display unit positionable on a surface comprising a base unit which comprises a platform and means disposed beneath the platform for moving the base unit along the surface. A pair of spaced apart standards extend upward from the platform and are adapted for supporting shelves. The base unit also includes at least one cantilevered shelf supportable at a selected position on the standards.

The present invention also includes adjustable shelving which includes a pair of standards and at least one cantilevered shelf supportable at selected positions on the standards. Each standard is characterized by a strip having a thickness and a front and back surface. Each shelf is further characterized by a pair of support members having a back portion at the rear corner of the shelf adapted for frictional engagement with the front surface of the strip of the standard. A pair of cam assemblies are mounted on each shelf one opposite the back portion of each support member so that a portion of a strip is receivable therebetween. Each cam assembly comprises a cam plate mounted for pivotation between an open position and a closed position. In the open position the cam plate is spaced a sufficient distance from the support member to permit the shelf to be moved along the strip disposed therebetween. In the closed position the cam plate is spaced a distance from the support member which is narrower than the thickness of the strip. As the cam plate is pivoted toward the closed position, the strip disposed therebetween will be frictionally engaged between the cam plate and the support member and the shelf will be rigidly supported on the standard at the point of the engagement. The cam assembly also comprises a means for continuously urging the cam plate toward the closed position.

Further, the present invention comprises a merchandise display unit positionable on a surface comprising a base unit. The base unit includes a skirted platform and means disposed beneath the platform and enclosed by the skirt for moving the base unit. A pair of standards extend upward from the platform and define a plane which is perpendicular to and bisects the base. Each standard comprises a pair of parallel strips joined by a spine to form a standard which defines a channel. Each of the strips has a thickness and a front and back surface.

A plurality of shelves are adjustably supported on the standards, and at least one shelf is mounted over each side of the platform. Each of the shelves comprises a pair of support members and corresponding cam assemblies, the cam assemblies being adapted for frictional engagement with the front surface of a strip. Each support member has a back portion located at the rear corner of the shelf, and a cam assembly is mounted opposite each back portion so that a portion of a strip is slidably receivable therebetween. When the shelf is mounted on the standard, the cam assembly will be enclosed by the channel of the standard.

Each cam assembly comprises a cam plate mounted for pivotation between an open position and a closed position. In the open position, the cam plate is spaced a sufficient distance from the back portion of the support member to permit the shelf to be moved along the strip disposed therebetween. In the closed position, the cam plate is spaced a distance from the back portion which is narrower than the thickness of the strip so that as the cam plate is pivoted toward the closed position the strip disposed therebetween will be frictionally engaged between the cam plate and the support member. Thus, the shelf will be rigidly supported on the standard at the point of engagement. Also, a cam arm is included in the assembly for moving the cam plate between the open and closed positions. The arm is accessible for manual operation while the shelf is maintained in a substantially level position. The cam assembly also includes means for continuously urging the cam plate toward the closed position.

DETAILED DESCRIPTION OF THE PREFERRED EMBODIMENT

Figure 1:
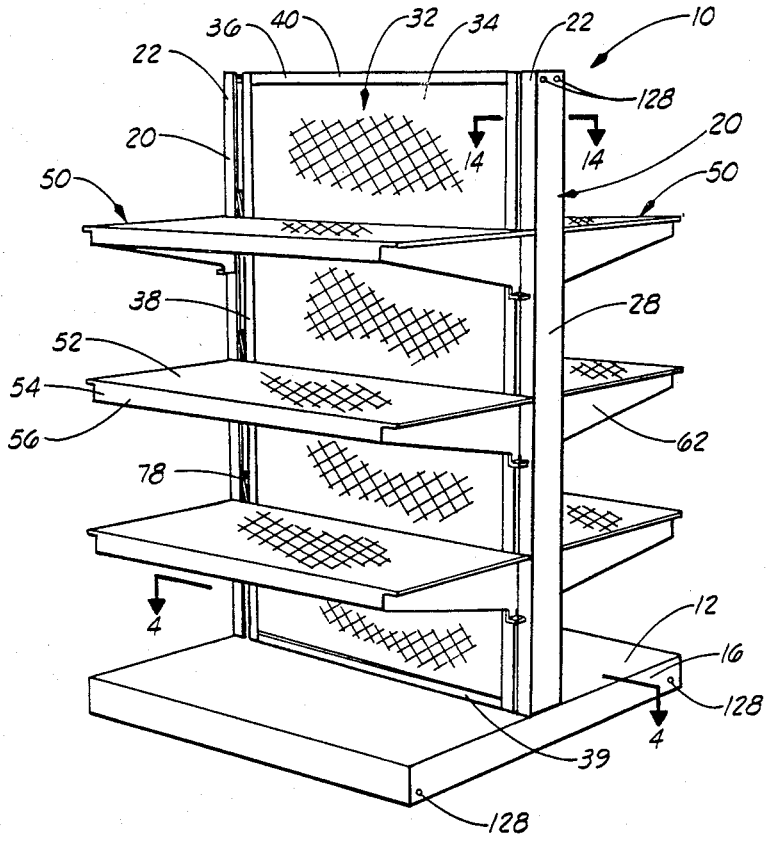
FIG. 1 is a perspective view of the base unit of the shelving of the present invention.

With reference now to the Figures in general, and to FIG. 1 in particular, the present invention comprises a merchandise display unit positionable on a surface such as a floor. The unit first comprises a base unit designated generally by the reference numeral 10.

Figure 2:
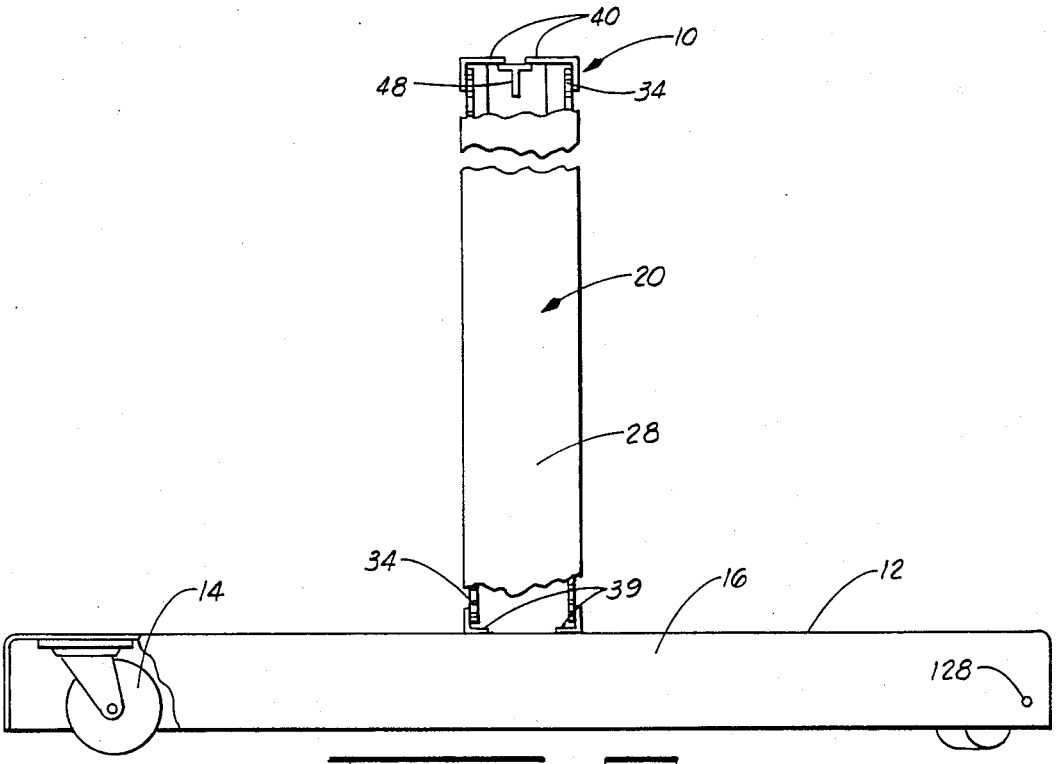
FIG. 2 is a fragmented side elevational view of the base unit shown in FIG. 1 (shelves not included). A portion at the top and bottom of the standard has been cut away to show the construction of the center panel. Also, a portion of the skirt on the platform of the base unit is cut away to show a caster.

The base unit 10 comprises a platform 12 which preferably is square but may take other shapes. With reference to FIG. 2, casters 14 are disposed beneath the platform 12 for moving the base unit 10 along the floor. A skirt 16 preferably extends downward around the platform 12 reaching nearly to the floor (not shown) and substantially enclosing the casters 14 underneath the platform. The platform 12 preferably is constructed of sturdy, solid metal.

Figure 3:
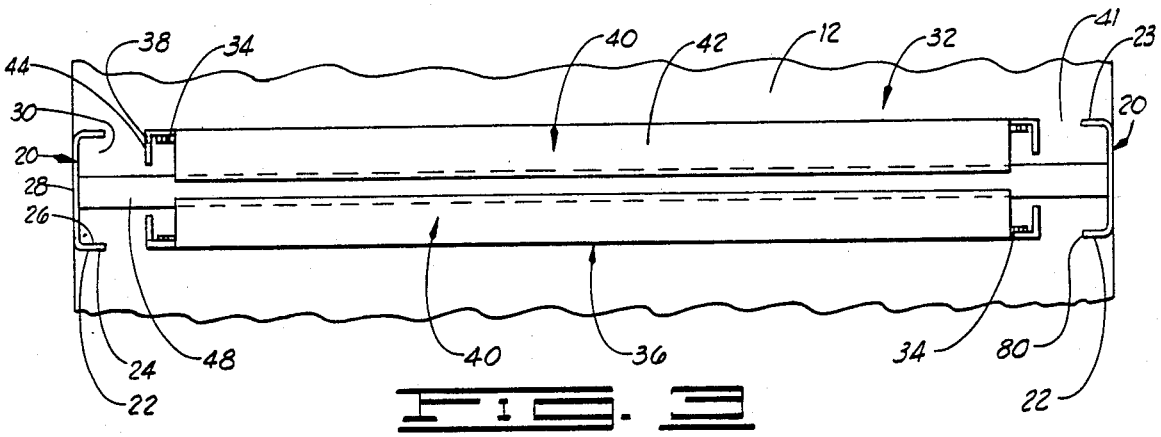
FIG. 3 is a top plan view of the base unit of FIG. 1 (shelves not included), with portions of the platform on both sides of the center panel cut away.
Figure 4:
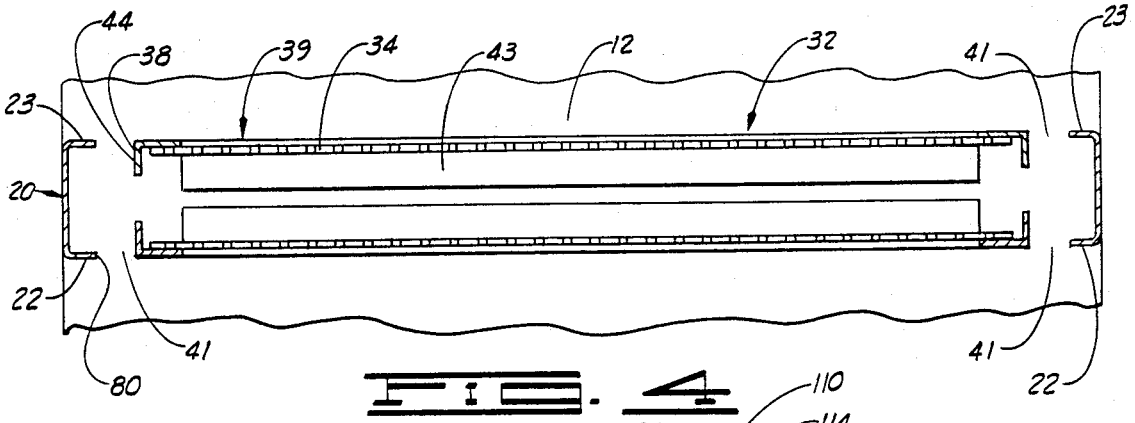
FIG. 4 is a cross sectional view at line 4 in FIG. 1 (shelves not included).

Still referring to FIGS. 1 and 2, the base unit 10 also comprises a pair of spaced apart standards both designated by the numeral 20. The standards 20 extend upward from the platform 12. In the preferred embodiment, the standards 20 are centered on the platform 12 so that the plane defined by the standards 20 is perpendicular to and bisects the platform 12. Each standard 20 has at least one strip 22 and preferably a pair of parallel strips 22 and 23. Each strip 22 is adapted for supporting shelves in a manner which will be described below. To this end, each strip has a thickness, a front surface 24 and a back surface 26, as best shown in FIGS. 3 and 4. A preferred shape for the standards 20 is provided by parallel strips 22 and 23 extending from a center spine 28. Thus, the standard 20 is substantially U-shaped in cross section and defines a longitudinal channel 30. More preferably, each standard 20 is a single length of metal bent into this configuration. The bottom end of the standards 20 then may be attached to the platform 12, as best shown in FIGS. 1 and 2. Preferably, the standards are permanently attached such as by welding.

For added stability and to separate the platform 12 into halves, a center panel 32 may be mounted between the standards 20. Preferably, the center panel 32 comprises a pair of rigid sheets 34, which may be standard sheet metal, or perforated or expanded metal. This sheet may be mounted on a frame 36 comprising two sides, both 38, a bottom 39 and a top 40. As will be later seen, the center panel 32 should be narrower than the distance between the standards 20 so that there is a space 41 between the standard 20 and the side 38 of the center panel, for a purpose which will be later described. Also, it is preferred to mount the sheet 34 so that it is substantially flush with the front surface 24 of the strips 22 on the standards 20.

The sides 38 and bottom and top 39 and 40 preferably are angled metal strips. The edges of the rigid sheet 34 may be affixed as by welding to the frame 36. Preferably, the edges of the sheet 34 are affixed to the inside surface of the frame 36, as best shown in FIGS. 3 and 4.

As indicated, and still referring to FIGS. 3 and 4, the bottom and top 39 and 40 and the sides 38 of the frame 36, are preferably formed of angled metal and therefore each has an inwardly directing flange. In the preferred embodiment, the top flange 42 and the bottom flange 43 are longer than the flanges 44 of the sides 38. The bottom flange 43 provides a surface for affixing the bottom of the frame 36 to the platform 12, preferably by welding. The top flange 42 provides a surface for connecting the top of the frame 36 to the standards 20. For attachment to the standards 20, a bar 48 may be provided which is T-shaped in cross section, as best shown in FIG. 2. As shown in FIG. 3, the ends of the bar 48 are attached, preferably welded, to the top of the standard 20, and the underside of the top flange 42 is affixed, preferably by welding, to the top of the bar 48.

In some instances, a base unit may be constructed to support shelves on only one side of the center panel. In these instances, the center panel may satisfactorily comprise a single sheet and this preferably will be mounted to be substantially flush with the side of the standards on which the shelves will be mounted.

It will be noted that in many instances expanded metal will be a preferred material for the rigid sheet. This is so because peg board hooks, commonly available, may be mounted in the spaces of the expanded metal. Peg board hooks may be combined with or used in lieu of shelving to display product.

Figure 9:
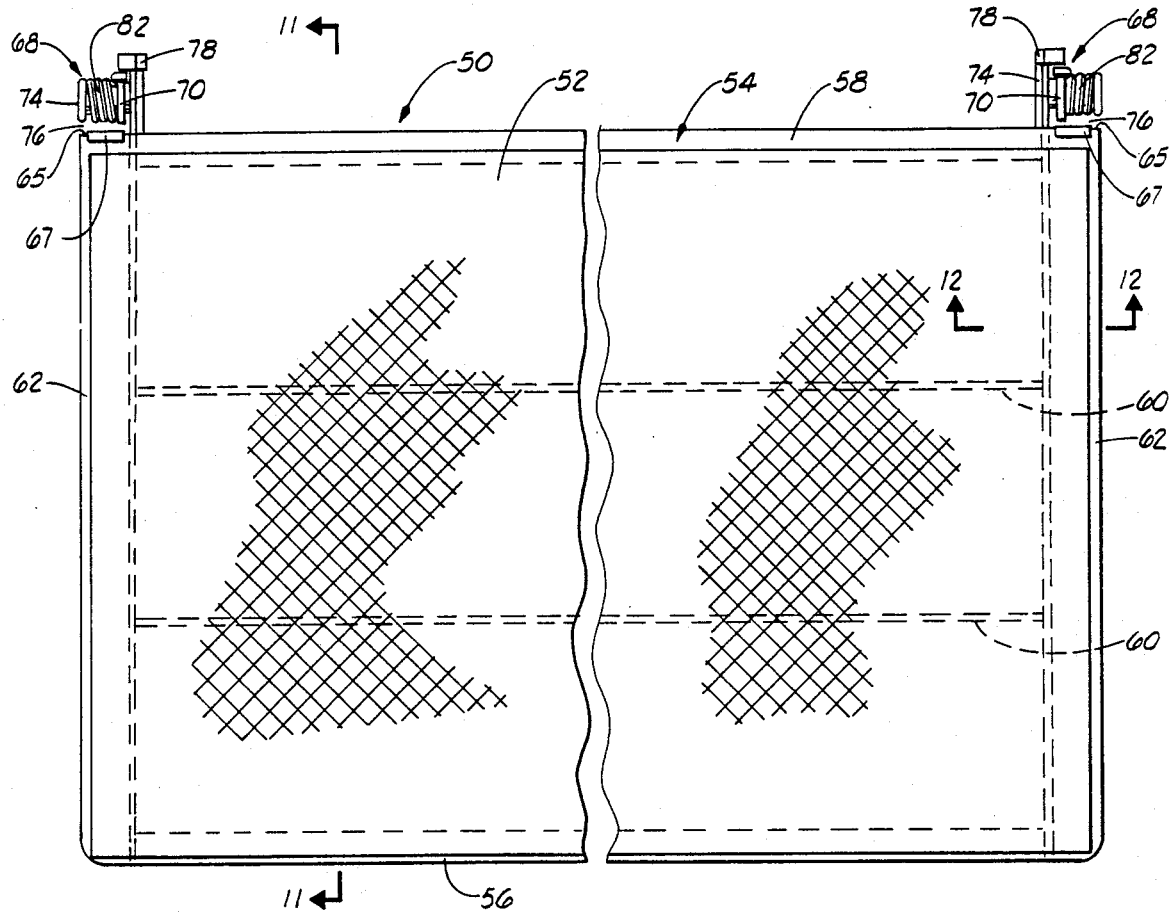
FIG. 9 is a fragmented top plan view of a shelf constructed in accordance with the present invention.

Referring again to FIG. 1, the base unit 10 also may comprise one or a plurality of cantilevered shelves 50 supportable at selected positions on the standards 20. Preferably, the shelves 50 are adjustably supportable n the standards 20. As best shown in FIG. 9, each shelf also preferably comprises a rigid sheet 52 of material, such as expanded metal, supported on a shelf frame 54. The shelf frame 54 comprises front 56 and rear 58 members and one or more center members 60 connected and preferably welded at each end to a pair of support members 62. The sheet 52 of expanded metal then preferably is attached or welded to the upper surface of the frame 54.

The shelves may be level or slanted, depending on the nature of the desired use or type of product to be displayed. Also, a combination of level and slanted shelves may be employed.

Figure 10:
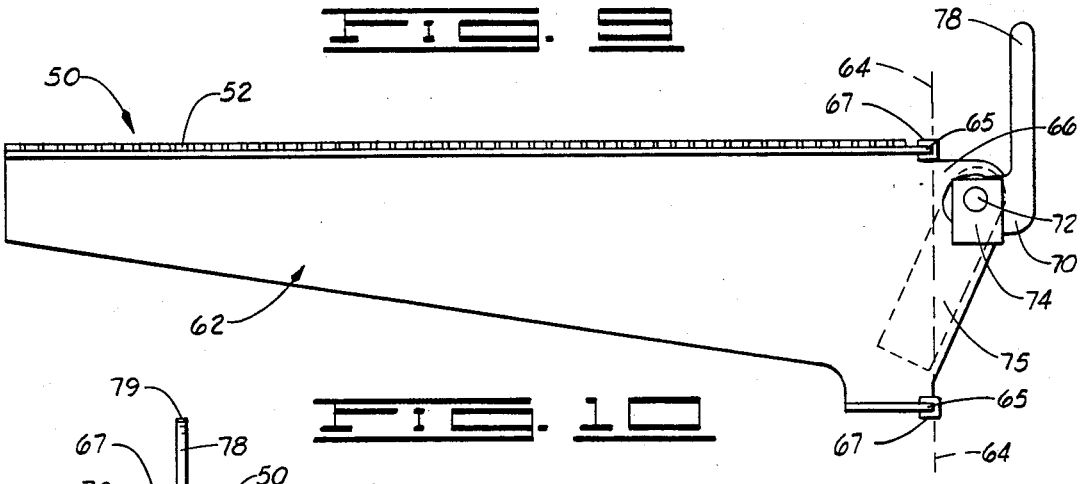
FIG. 10 is a side elevational view of the shelf in FIG. 9.
Figure 11:
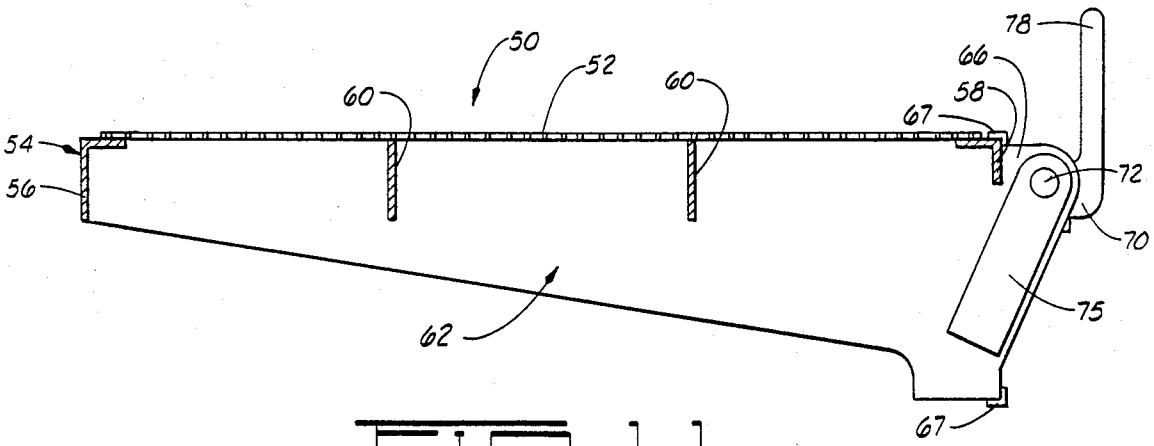
FIG. 11 is a cross sectional view taken along line 11 of FIG. 9.

Each shelf 50 preferably is adapted for adjustable mounting on the standards 20. To this end, the rear of support member 62 is generally wider than the front, as best shown in FIGS. 10 and 11. Also, the rear of the support member preferably is characterized by a C-shaped back portion 64, best seen in FIGS. 12 and 13. The back portion 64 has aligned edges 65, as shown in FIGS. 10 and 13, which can frictionally engage the front surface 24 of the strip 22 of a standard 20 molding 67, preferably made of nylon, may be fitted over the edges 65 to protect the front surface 24 of the strips.

Figure 14:
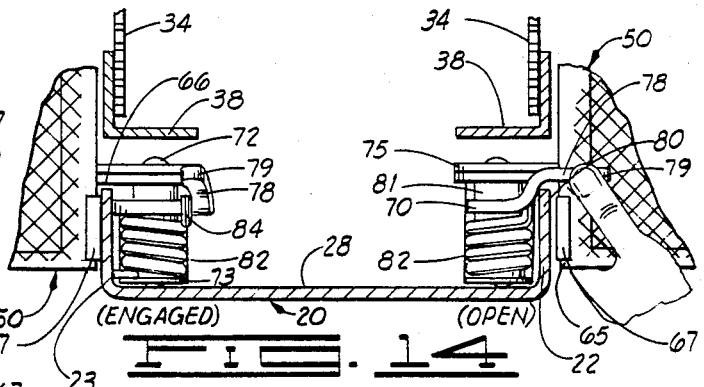
FIG. 14 is an enlarged, partial cross sectional view taken along line 4 in FIG. 1.
Figure 15:
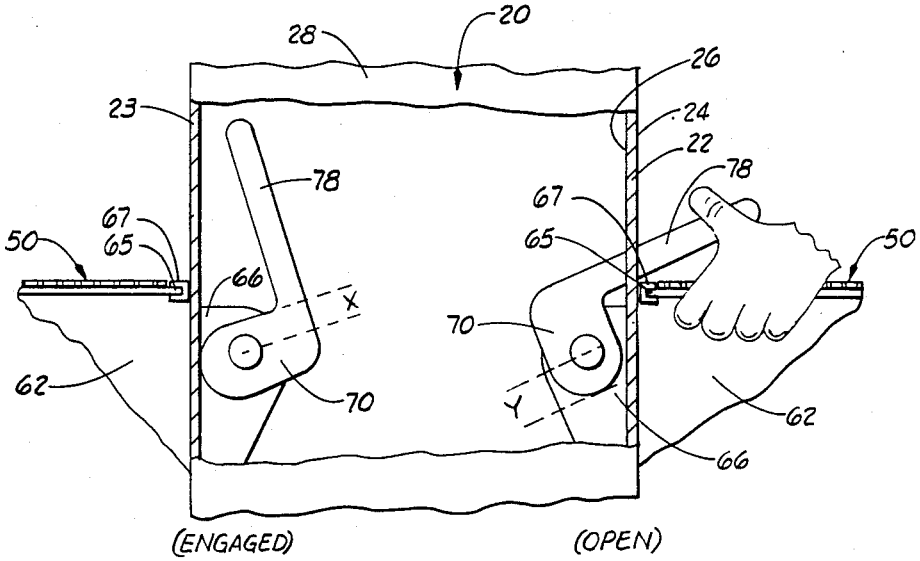
FIG. 15 is an enlarged, partial side elevational view of the base unit in FIG. 1 taken in the same area as the cross sectional view of FIG. 14. The spine of the standard, cradles and springs have been omitted to fully disclose the cam plates.

Referring again to FIG. 9, the shelf 50 also preferably comprises a pair of cam assemblies 68, one positioned opposite the back portion 64 of each support member 62. The cam assembly 68 is spaced a distance from the back portion of the support member to receive a strip 22 therebetween. The cam assembly 68 is supported on a middle portion 66 of the support member 62 which extends through the space 41 between the standard 20 and the center panel 32, as best shown in FIGS. 14 and 15. The cam assembly 68 and the back 64 of the support member 62 cooperate to engage and disengage the strip 22 for adjusting and mounting the shelf 50 thereon. Where a channeled or U-shaped standard is employed, the cam assembly 68 preferably will be mounted so as to be enclosed or hidden inside the channel 30, as shown in FIGS. 14 and 15.

Figure 13:
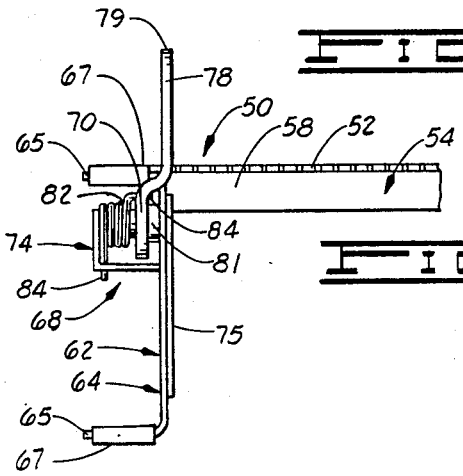
FIG. 13 is a partial rear view of one end of the shelf of FIG. 9 and featuring the cam assembly.
Figure 12:
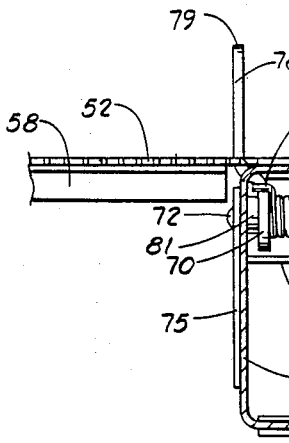
FIG. 12 is a partial cross sectional view of one end of the shelf in FIG. 9 taken along line 12 and featuring the cam assembly.

With reference now to FIGS. 12 and 13, the cam assembly 68 preferably comprises a cam plate 70 mounted for pivotation on a pin 72 seated in a cradle 74. The assembly 68 should be sized so that the free end 73 of the cradle 74 easily clears the inside of the spine 28 of the standard 20. For additional strength a doubler 75, such as a strip of metal, may be welded onto the outside of the portion of the support member 62 which forms the cradle 74 and supports the pin 72 and cam plate 70.

As best shown in FIG. 15, the shape of the cam plate 70 is such that it has an edge with a radius X and an edge with a radius Y, the Y radius being greater than the X radius. The edge of the cam plate 70 is adapted for frictionally engaging the back surface 26 of the strip 22. In this way, the width of the strip receiving space 76 formed between the cam assembly 68 and the support member back 64 may be widened or narrowed by pivoting the cam plate 70. When the cam plate 70 is pivoted so that the portion of the edge having the X radius is opposite the back 64, the cam plate is in an open position; that is, the space 76 is of sufficient width to permit the shelf 50 to be moved up or down along a strip 22 disposed therein. On the other hand, when the cam plate 70 is pivoted so that the edge having the Y radius is opposite the back 64, the cam plate is in the closed position wherein the space 76 is narrower than the thickness of the strip 22.

Thus, the shelf 50 may be positioned at selected positions along the length of the standard 20. First, with the shelf in a substantially level position with respect to the platform 12 and with the cam plate 70 rotated to the open position, the cam assemblies 68 of the shelf 50 are introduced into the channel 30 at the top of the standards 20, so that the strip 22 is slidably received in the strip receiving space 76. With the cam plate 70 still in the open position, the shelf 50 then is moved to the selected height over the platform 12, as shown in FIG. 14. Once the shelf 50 is positioned at the desired level, the cam plate 70 is pivoted toward the closed position and as it approaches the closed position, the strip is grippingly and rigidly engaged between the back 64 and the edge of the cam plate 70, also depicted in FIGS. 14 and 15.

For convenient operation of the cam assembly 68, the cam plate 70 may be provided with an arm 78, as shown in FIGS. 11–15. As indicated above, the cam assembly 68 preferably is disposed so that when the shelf 50 is mounted in the standard 20, the cam assembly 68 will be enclosed by the channel 30 of the standard. For this reason, it is preferred to bend the arm 78 (see FIG. 13) so that while a portion of the arm extends from the cam plate 70, the free end 79 of the arm 78 clears the inner edge 80 of the strip 22. Thus, the arm 78 is readily accessible from outside the standard 20, even though the cam plate 70 and its assembly 68 are fully enclosed inside the channel 30, as best shown in FIGS. 14 and 15. A spacer 81 may be mounted on the pin 72 to maintain the cam plate 70 in proper position.

The arm 78 allows the cam plate 70 to be operated by the thumb while the shelf 50 is gripped by the fingers of the hand at the side of the support members 62. It should be noted that the cam assemblies 68 can be operated independently. Thus, the shelf 50, with or without product displayed on it, may be adjusted up or down on the standard 20 by gripping the shelf 50 at both ends and operating one cam assembly 68 with each thumb.

To maintain the cam plate 70 in the engaged position so that the shelf 50 will be rigidly supported at the selected position, the cam assembly 68 may be provided with a torsion spring 82. The spring 82, best shown in FIGS. 12–14, is mounted on the pin 72 with ends 84 disposed so as to continuously urge the plate 70 toward the closed position. Then, to pivot the cam plate 70 to the open position, the arm 78 is depressed against the pressure of the spring 82 urging the arm 78 in the opposite direction, as shown in FIGS. 14 and 15.

Figure 5:
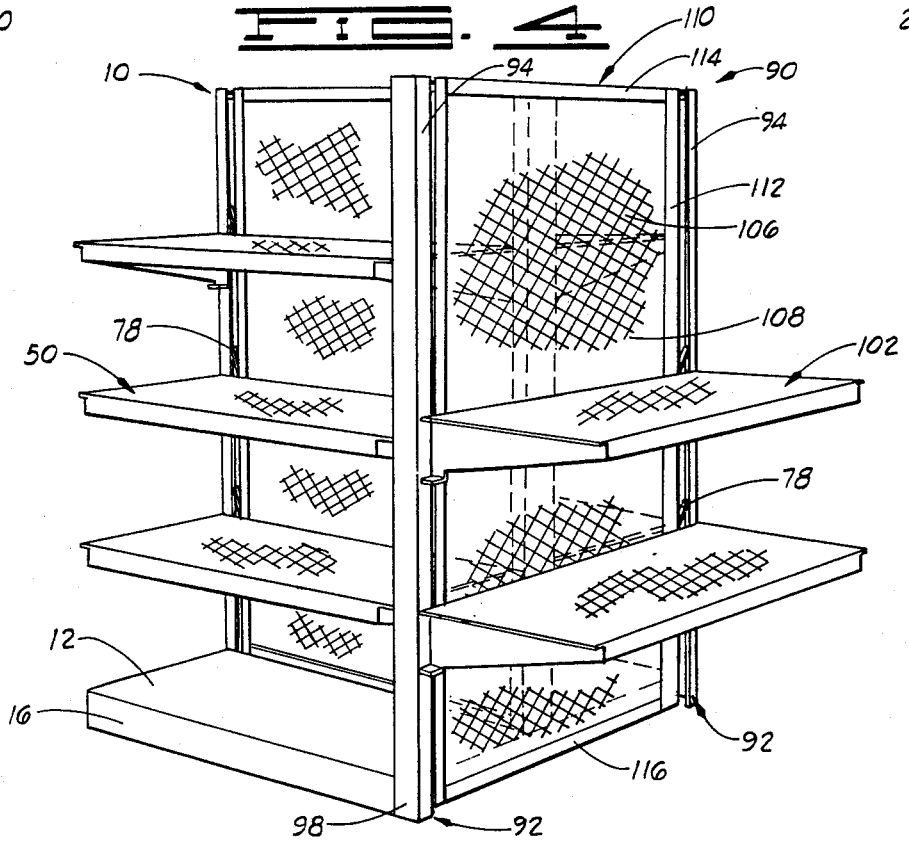
FIG. 5 is a perspective view of the present invention wherein a side unit is attached to the base unit in a "T" assembly.

Turning now to FIG. 5, the merchandise display unit of the present invention further preferably comprises at least one side unit removably connectable to the base unit 10. The side unit, designated generally by the reference numeral 90, comprises a pair of spaced apart standards 92. When connected to the base unit, the side unit standards 92 are disposed so as to form a plane which is perpendicular to the platform 12 and the center panel 32 (or the plane formed by the base unit standards 20) to form a "T" assembly.

Figure 7:
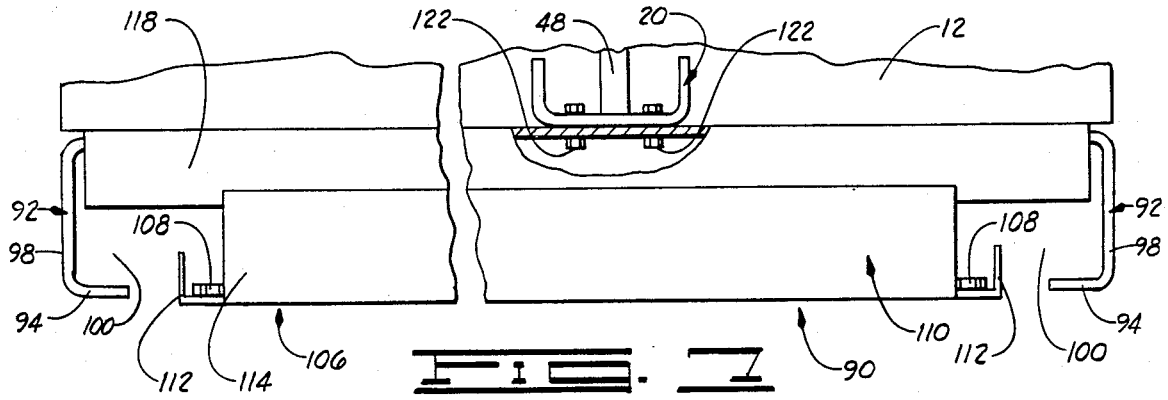
FIG. 7 is a fragmented top plan view of the T assembly of FIG. 5. A portion of the top of the side unit is cut away to show attachment to the top of the base unit standard.
Figure 8:
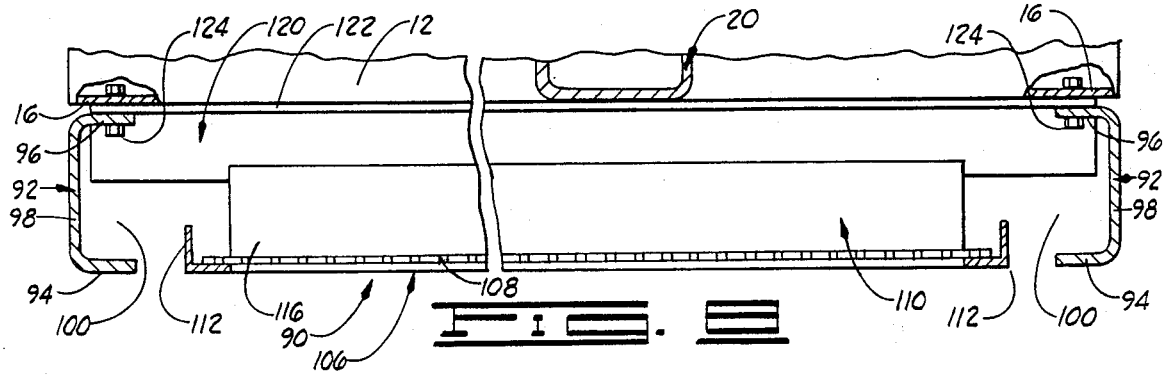
FIG. 8 is a fragmented cross-sectional view along line 8 in FIG. 6. Portions of the platform corners are cut away to show attachment of the side unit to the skirt of the platform.

The side unit standards 92 each are characterized preferably by a strip 94 similar to the strip 22 on the base unit standards and are similarly adapted for supporting shelves, preferably in an adjustable manner. As shown in FIGS. 7 and 8, the preferred side unit standard 92 comprises a pair of strips 94 and 96, preferably parallel and extending from a spine 98 to form a U-shaped standard which defines a channel 100.

The channel 100 and the forward strip 94 receive and support at least one and preferably a plurality of shelves 102. The shelves 102 are constructed in a similar fashion as the base unit shelves 50, described above. In this regard, it will be noted that where the platform of the base unit is square, the standards for the side unit and the standards for the base unit will be spaced an equal distance apart. Thus, shelves for the side unit and the base unit may be identical and interchangable.

A back panel 106 is disposed between the side unit standards 92 for stabilizing the standards and for separation of the back of the side unit 90 from the side of the base unit 10. The back panel 106 preferably comprises a single sheet 108 of expanded metal similar to the center panel 32 of the base unit, and also preferably disposed so that the surface of the back panel will be substantially flush with the side unit standards 92. The sheet 108 is mounted in a frame 110 composed of two sides 112 and a top 114 and a bottom 116. Preferably, the sides 112, top and bottom 114 and 116 are angled metal, and the edges of the sheet 108 are affixed as by welding to the outer surface of the angled pieces.

It will be preferred in most instances to construct the back panel 106 and the standards 92 of the side unit 90 to have a length equal to the combined length of the skirt 16 and the standards 20 of the base unit 10. This allows the side unit 90 to be connected to the base unit whereby the top and bottom of the side unit and base unit are flush.

Figure 6:
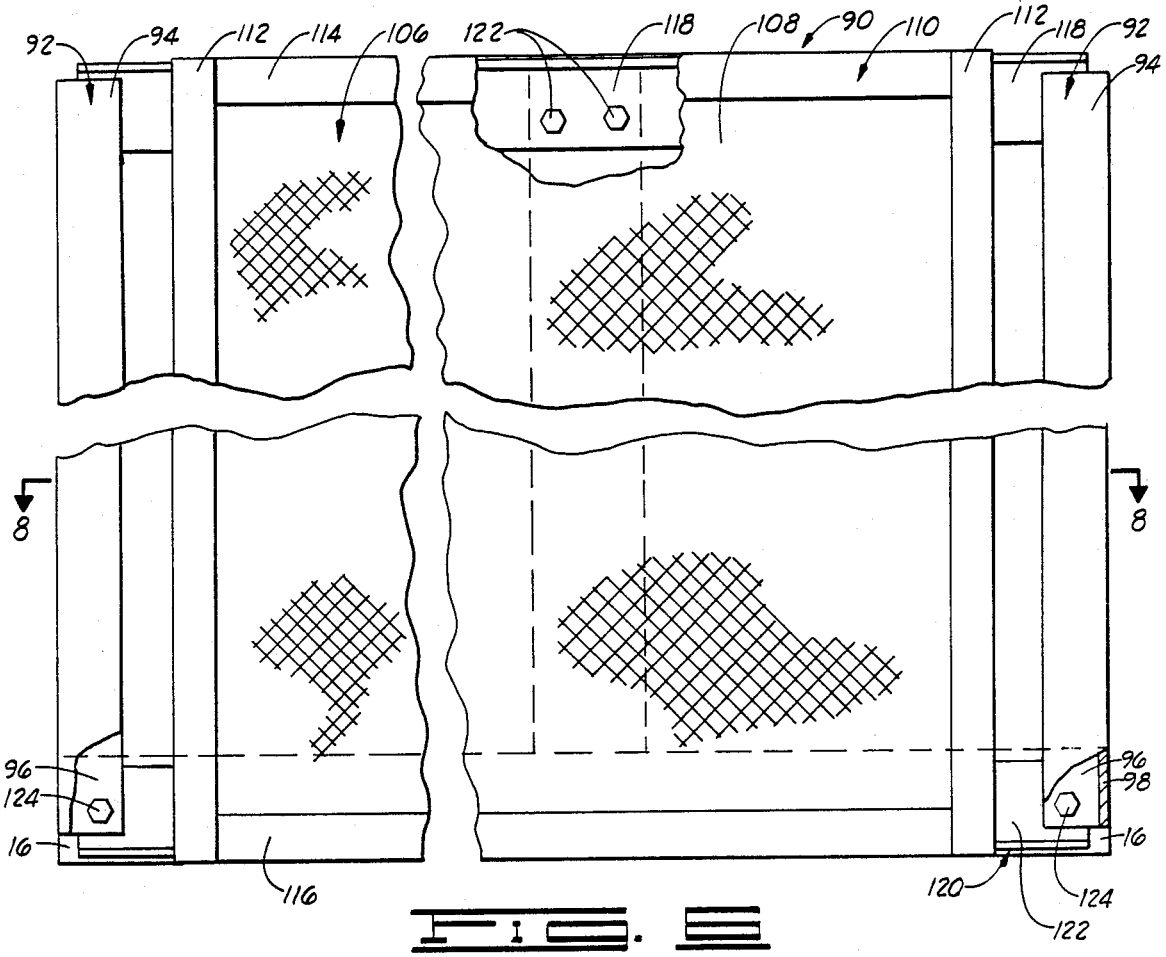
FIG. 6 is a fragmented side elevational view of the T assembly shown in FIG. 5 (shelves not included). Portions of the bottom of the side standards are cut away to show attachment to the platform, and an upper portion of the back panel is cut away to show attachment to the top of the base unit standard.

For mounting to the base unit 10, the side unit 90 is also provided with a top and a bottom cap 118 and 120. The caps 118 and 120 also preferably are constructed of sturdy angled metal. The caps 118 and 120 preferably are longer than the top and bottom 114 and 116 of the frame 110 so that the caps may be secured as by welding to the top and bottom ends of the rearward strips 96 of the side unit standards 92, as shown in FIGS. 6–8. Thus, the caps 118 and 120, the standards 92 and the back panel 106 may be formed into a single weldment.

The side unit 90 then may be removably and securely connected to the side of the base unit 10 in some suitable fashion. For example, the center of the top cap 118 may be connected by bolts 122 or the like to the upper end of the ajacent base unit standard 20, as shown in FIG. 7. Then, the bottom of the side unit 90 may be connected to the platform 12 of the base unit 10, such as by bolts 124 through the skirt 16, as best shown in FIG. 8. For maximum stability the bolt is positioned to pass through the rearward strip 96 of the side unit standard 92 as well as the upright back 126 of the cap 120 and the skirt. It will be understood that where bolts are utilized, the base unit standards 20 and the skirt 16 may be provided with bolt holes 128, as shown in FIGS. 1 and 2.

Thus, the single weldment side unit 90 easily may be connected and disconnected from the movable base unit 10 as display demands dictate. Also, it will be noted that two side units may be connected to produce an "H" configuration (not shown) whereby shelves may be mounted on all four sides of he movable merchandise display unit.

While the movable platform of the present invention is an especially desirable way to support the previously described standards and adjustable shelves, it now will be understood that standards and shelves made in accordance with the present invention may be used without such a platform. Adjustable shelving in accordance with the present invention comprises a pair of standards and at least one cantilevered shelf, all as described above. The standards may be mounted in any suitable fashion, such as by affixing the standards to a rear wall. Alternately, a side unit, constructed as described above and shown in FIGS. 6–8 may be supported by bolting the rearward strip 96 of the standards to a supporting surface, such as a wall. Then the above described shelves with cam assemblies may be adjustably supported on the mounted standards.

Based on the foregoing, it can be appreciated that the merchandise display unit of the present invention provides an attractive and convenient shelving unit for displaying product, such as merchandise in a self-service retail or convenience store. The cam-type adjustment means of the present invention allows the shelves to be adjusted without removing or disturbing product displayed on the shelf. Yet, the cam assembly is enclosed by the standard. The hidden cam assembly not only is protected against inadvertent disengagement, but is more appealing visually, as well.

Because the entire unit is movable, merchandise may be rearranged simply by turning or moving the base unit on its casters. Also, the traffic flow in a display area may be easily and quickly manipulated simply by moving one or more units into varying arrangements. The skirted platform of the base unit encloses the casters and thereby prevents accidental injuries to feet as well as concealing debris which inevitably collects under such shelving. At the same time, the unit promotes easy cleaning of the unit itself, as well as of the surrounding area. The entire unit can be moved with little effort and time to clean underneath it as often as desired. Also, the expanded metal allows smaller matter to drop through to the smooth platform underneath where it can be easily removed.

Because the base unit, side units and shelves each are single weldments, the merchandise display unit comprises a minimum of elements. Thus, is it not only simple to assemble, but very versatile as well. Using only bolts and a wrench, the unit may be converted to a 2-sided unit (base unit only), a 3-sided unit (1 side unit on a base unit in a "T" arrangement), or a4-side units (2 side units mounted on a base unit in an "H" arrangement). Also, because of its construction, the unit requires little or no maintenance.

Changes may be made in the nature, composition, operation and arrangement of the various elements, steps and procedures described herein without departing from the spirit and scope of the invention as defined in the following claims.

What is claimed is:

1. A merchandise display unit positionable on a surface, comprising:

a base unit, comprising:

a platform;

a pair of spaced apart standards extending upward from the platform, each standard defining at least one strip having a thickness and characterized by a front and back surface;

at least one cantilevered shelf supportable on the standards, each shelf characterized by a pair of support members, one at each rear corner of the shelf, each having a back portion adapted for frictionally engaging the front surface of the strip, and each shelf comprising a pair of cam assemblies mounted on the shelf opposite the back portion of each support member so that a portion of the strip is receivable therebetween, wherein each cam assembly comprises:

a cam plate adapted for frictional engagement with the back surface of the strip and mounted for pivotation between an open position and a closed position, wherein in the open position the cam plate is spaced a distance from the back portion of the support member of the shelf which is greater than the thickness of the strip to permit the shelf to be moved along the strip disposed therebetween, and wherein in the closed position the cam plate is spaced a distance from the back portion of the support member which is narrower than the thickness of the strip so that as the cam plate is pivoted toward the closed position, the cam plate engages the back surface of the strip and the back portion of the support member engages the front surface and the strip thereby is gripped between the cam plate and the back portion of the support member so that the shelf is rigidly mounted on the standard at the point of engagement; and means for continuously urging the cam plate toward the closed position.

2. The merchandise display unit of claim 1 in which each standard comprises a spine from which the strip extends at an angle to form a channel; wherein the cam assembly is enclosed in the channel of the standard on which it is supported; and wherein the cam plate is characterized by an arm by which the cam plate may be moved between the open and the closed positions, the arm being accessible for manual adjustment of the position of the shelf while the shelf is maintained in a substantially level position.

3. The merchandise display unit of claim 2 in which the platform is characterized by a skirt extending downward from and around the platform and in which the base unit further comprises:

means for moving the base unit along the surface, such moving means being disposed beneath the platform and substantially enclosed by the skirt.

4. The merchandise display unit of claim 1 in which the standards together define a plane which is perpendicular to and bisects the platform; in which each standard is characterized by a pair of strips, each strip having a front and a back surface and a thickness therebetween; and wherein the strips in each standard are parallel and spaced a distance apart to permit shelves to be mounted back-to-back thereon.

5. The merchandise display unit of claim 4 wherein the strips of each strip extend from a spine to form a standard which defines a channel; wherein each cam assembly is enclosed in the channel of the standard on which it is supported; and wherein each cam plate is characterized by an arm by which the cam plate may be moved between the closed position and the open position, the arm being accessible for manual adjustment of the shelf position while the shelf is maintained in a substantially level position.

6. The merchandise display unit of claim 5 in which the platform is characterized by a skirt extending downward from and around the platform and in which the base unit further comprises:

means for moving the base unit along the surface, such moving means being disposed beneath the platform and substantially enclosed by the skirt.

7. The merchandise display unit of claim 1 further comprising at least one side unit removably connected to the base unit, each side unit comprising:

a pair of spaced apart side unit standards defining a plane which is perpendicular to the platform and to the plane of the base unit standards and adapted for supporting merchandise.

8. The merchandise display unit of claim 7 further comprising:

at least one cantilevered shelf supportable at selected positions on the side unit standards; and wherein each of the side unit standards is characterized by a strip having a thickness and a front and back surface; wherein each shelf is characterized by a pair of support members one at each rear corner of the shelf and each having a back portion adapted for frictional engagement with the front surface of a strip; and wherein each shelf comprises a pair of cam assemblies, one mounted on the shelf opposite the back portion of each support member so that a portion of a strip is receivable therebetween, each cam assembly comprising:

a cam plate adapted for frictional engagement with the back surface of the strip and mounted for pivotation between an open position and a closed position, wherein in the open position the cam plate is spaced a distance from the back portion of the support member of the shelf greater than the thickness of the strip to permit the shelf to be moved along the strip disposed therebetween, and wherein in the closed position the cam plate is spaced a distance from the support member which is narrower than the thickness of the strip so that as the cam plate is pivoted toward the closed position, the cam plate engages the back surface of the strip and the back portion of the support member engages the front surface and the strip thereby is gripped between the cam plate and the back portion of the support member so that the shelf is rigidly mounted on the standard at the point of engagement; and means for continuously urging the cam plate toward the closed position.

9. The merchandise display unit of claim 8 in which each side unit standard and each base unit standard comprises a spine from which the strip extends at an angle to form a channel; wherein each cam assembly is enclosed by the channel of the standard on which it is supported; and wherein each cam plate is characterized by an arm by which the cam plate may be moved between the open and the closed positions, the arm being accessible for manual adjustment of the position of the shelf while the shelf is maintained in a substantially level position.

10. The merchandise display unit of claim 8 comprising two side units.

11. The merchandise display unit of claim 10 in which each side unit standard and each base unit standard comprises a spine from which the strip extends at an angle to form a channel; wherein each cam assembly is enclosed by the standard on which it is supported; and wherein each cam plate is characterized by an arm by which the cam plate may be moved between the open and the closed positions, the arm being accessible for manual adjustment of the position of the shelf while the shelf is maintained in a substantially level position.

12. Adjustable shelving, comprising:

a pair of spaced apart standards, each characterized by a strip having a thickness and a front and back surface;

at least one cantilevered shelf supportable at selected positions on the standards, each shelf being characterized by a pair of support members each having a back portion at the rear corner of the shelf adapted for frictional engagement with the front surface of a strip;

a pair of cam assemblies mounted on each shelf, one being opposite the back portion of each support member so that a portion of a strip is receivable therebetween, each cam assembly comprising:

a cam plate adapted for frictional engagement with the back surface of the strip and mounted for pivotation between an open position and a closed position, wherein in the open position the cam plate is spaced a distance from the back portion of the support member of the shelf greater than the thickness of the strip to permit the shelf to be moved along the strip disposed therebetween, and wherein in the closed position the cam plate is spaced a distance from the back portion of the support member which is narrower than the thickness of the strip so that as the cam plate is pivoted toward the closed position, the cam plate engages the back surface of the strip and the back portion of the support member engages the front surface and the strip thereby is gripped between the cam plate and the back portion of the support member so that the shelf is rigidly mounted on the standard at the point of engagement; and means for continuously urging the cam plate toward the closed position.

13. The adjustable shelving of claim 12 in which the strip of each standard extends at an angle from a spine to form a channel; wherein each cam assembly is enclosed by the channel of the standard on which it is supported; and wherein the cam plate is characterized by an arm for moving the cam plate between the open and the closed positions, the arm being accessible for manual adjustment of the position of the shelf while the shelf is maintained in a substantially level position.

14. A merchandise display unit positionable upon a surface, comprising:

a base unit which comprises:

a platform having a skirt;

means disposed beneath the platform and enclosed by the skirt for moving the base unit along the surface; and a pair of spaced apart standards extending upward from the platform together defining a plane which is perpendicular to and bisects the platform, each standard comprising a pair of parallel strips extending from a spine to form a channel and each strip having a front and back surface and a thickness;

a plurality of shelves adjustable mounted on the standards, at least one of such shelves being mounted over each side of the platform and each of the shelves comprising:

a pair of support members, each having a back portion at the rear corner of the shelf adapted for frictional engagement with the front surface of a strip; and a pair of cam assemblies, one positioned opposite the back portion of each support member so that a strip is slidably receivable therebetween, and so that when the shelf is mounted on the standard, the cam assembly will be enclosed by the channel of the standard, each cam assembly comprising:

a cam plate adapted for frictional engagement with the back surface of the strip and mounted for pivotation between an open position and a closed position, wherein in the open position the cam plate is spaced a distance from the back portion of the support member of the shelf greater than the thickness of the strip to permit the shelf to be moved along the strip disposed therebetween, and wherein in the closed position the cam plate is spaced a distance from the back portion of the support member which is narrower than the thickness of the strip so that as the cam plate is pivoted toward the closed position, the cam plate engages the back surface of the strip and the back portion of the support member engages the front surface and the strip which is thereby gripped between the cam plate and the support member so that the shelf is rigidly mounted on the standard at the point of engagement;

a cam arm extending from the cam plate for moving the cam plate between the open and closed positions and being accessible for manual operation to reposition the shelf while the shelf is maintained in a substantially level position; and means for continuously urging the cam plate toward the closed position.

15. The merchandise display unit of claim 14 further comprising at least one side unit removably connectable to the base unit, each side unit comprising:

a pair of spaced apart standards together defining a plane which is perpendicular to the platform and to the plane of the base unit standards, each standard comprising a strip extending at an angle from a spine to define a channel, the strip having a front and back surface and a thickness;

at least one shelf adjustable mounted on the side unit standards, each shelf comprising:

a pair of support members, each having a back portion at the rear corner of the shelf adapted for frictional engagement with the front surface of a strip; and a pair of cam assemblies, one positioned opposite the back portion of each support member so that a strip is slidably receivable therebetween, and so that when the shelf is mounted on the standard, the cam assembly will be enclosed by the channel of the standard, each cam assembly comprising:

a cam plate adapted for frictional engagement with the back surface of the strip and mounted for pivotation between an open position and a closed position, wherein in the open position the cam plate is spaced a distance from the back portion of the support member of the shelf greater than the thickness of the strip to permit the shelf to be moved along the strip disposed therebetween, and wherein in the closed position the cam plate is spaced a distance from the back portion of the support member which is narrower than the thickness of the strip so that as the cam plate is pivoted toward the closed position, the cam plate engages the back surface of the strip and the back portion of the support member engages the front surface and the strip thereby is gripped between the cam plate and the back portion of the support member so that the shelf is rigidly mounted on the standard at the point of engagement;

a cam arm extending from the cam plate for moving the cam plate between the open and closed positions and being accessible for manual operation to reposition the shelf while the shelf is maintained in a substantially level position; and means for continuously urging the cam plate toward the closed position.

16. The merchandise display unit of claim 15 comprising two side units.

* * * * *

UNITED STATES PATENT AND TRADEMARK OFFICE

CERTIFICATE OF CORRECTION

PATENT NO. : 4,919,282

DATED : April 24, 1990

INVENTOR(S) : Terry L. Duff and William R. Gundlach

It is certified that error appears in the above—identified patent and that said Letters Patent is hereby corrected as shown below:

Col. 6, line 65, please delete the word "ajacent" and substitute therefor the word -- adjacent --.

Col. 7, line 62, please delete the words "a4-side" and substitute therefor the words -- a 4-side --.

Col. 11, line 8, please delete the word "adjustable" and substitute therefor the word -- adjustably --.

Col. 12, line 7, please delete the word "adjustable" and substitute therefor the word -- adjustably --.

Signed and Sealed this

Seventh Day of April, 1992

*Attest:*

HARRY F. MANBECK, JR.

*Attesting Officer*

*Commissioner of Patents and Trademarks*